US010100704B2

(12) United States Patent
Zhao et al.

(10) Patent No.: US 10,100,704 B2
(45) Date of Patent: Oct. 16, 2018

(54) EXHAUST MANIFOLD

(71) Applicant: GM GLOBAL TECHNOLOGY OPERATIONS LLC, Detroit, MI (US)

(72) Inventors: Guangzhi A. Zhao, Troy, MI (US); Kenneth L. Marotta, Macomb, MI (US); Vincent J. Tylutki, Livonia, MI (US); Charles F. Maguire, III, Metamora, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 36 days.

(21) Appl. No.: 15/347,946

(22) Filed: Nov. 10, 2016

(65) Prior Publication Data

US 2018/0128150 A1 May 10, 2018

(51) Int. Cl.

| | |
|---|---|
| ***F01N 13/06*** | (2010.01) |
| ***F01N 13/10*** | (2010.01) |
| ***F01N 13/00*** | (2010.01) |
| ***F02D 41/14*** | (2006.01) |
| ***F01N 13/18*** | (2010.01) |

(52) U.S. Cl.

CPC ..... *F01N 13/06* (2013.01); *F01N 13/008* (2013.01); *F01N 13/10* (2013.01); *F01N 13/1805* (2013.01); *F02D 41/1454* (2013.01); *F01N 2340/04* (2013.01); *F01N 2560/025* (2013.01)

(58) Field of Classification Search

CPC ..... F01N 13/008; F01N 13/06; F01N 13/10; F01N 13/1805; F01N 2340/04; F01N 2560/025

See application file for complete search history.

(56) References Cited

U.S. PATENT DOCUMENTS

| | | | | |
|---|---|---|---|---|
| 4,373,329 | A | 2/1983 | Martini | |
| 4,731,995 | A | 3/1988 | McFarland | |
| 2005/0262836 | A1* | 12/2005 | Bassani | F01N 13/1805 60/313 |
| 2007/0137189 | A1* | 6/2007 | Kikuchi | F01N 13/08 60/313 |
| 2010/0082297 | A1 | 4/2010 | Turin | |
| 2013/0098007 | A1* | 4/2013 | Waggoner | F01N 3/046 60/299 |

(Continued)

OTHER PUBLICATIONS

Performance Exhaust System Design and Theory, Exhaust Tech, Design, Theory and Intro to Fluid Dynamics Posted by Trevor Anderson, May 2, 2016 pp. 1-21.

*Primary Examiner* — Audrey K Bradley

(57) ABSTRACT

An exhaust manifold for a vehicle engine may include a plurality of pipes, a pod, a splined collector and a downpipe. Each pipe in the plurality of pipes are operatively configured to be coupled to a corresponding engine chamber at a proximate portion. The pod is operatively configured to align a flow of exhaust gas emerging from each of the corresponding engine chambers to the associated pipe in the plurality of pipes. The splined collector receives the outlet ends of the pipes at a splined collector inlet. The downpipe may be affixed to the splined collector at a small diameter outlet portion. The downpipe includes a first oxygen sensor operatively configured to communicate with a second oxygen sensor disposed in a downstream catalytic converter and an ECM in order to regulate air and fuel for the vehicle engine.

16 Claims, 4 Drawing Sheets

(56) References Cited

U.S. PATENT DOCUMENTS

| | | | |
|---|---|---|---|
| 2015/0267597 | A1 | 9/2015 | Fischer |
| 2016/0146086 | A1 | 5/2016 | Lee |
| 2016/0177795 | A1 | 6/2016 | McHenry |

* cited by examiner

EXHAUST MANIFOLD

TECHNICAL FIELD

The present disclosure relates to an exhaust manifold for a vehicle engine.

INTRODUCTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engines combust a mixture of air and fuel to produce drive torque and propel a vehicle. More specifically, air is drawn into an engine through a throttle valve. Fuel provided by one or more fuel injectors mixes with the air to form the air/fuel mixture. The air/fuel mixture is combusted within one or more cylinders of the engine to produce torque. An engine control module (ECM) controls torque output by the engine.

An exhaust manifold is a component of the exhaust system of combustion engines and has an internal pipe system which transfers exhaust gases from the engine cylinders through the catalyst and eventually to the muffler. The exhaust manifold serves many purposes including to unite or collect exhaust gas to a common exhaust-gas outlet. For this purpose, such an exhaust manifold is traditionally flange mounted directly onto the engine or the cylinder head. Thus, the exhaust manifold, includes a collector and runners and tertiary pipe where the runners attach on one end directly to the cylinder heads of the engine and merge at the collector at the opposite end. The collector serves to mix the gases from the exhaust system. From the collector, the exhaust gases move through the catalytic converter out the exhaust pipes and then out the muffler As indicated, exhaust gas resulting from combustion of the air/fuel mixture is expelled from the cylinder head to the exhaust system. One or more oxygen sensors measure oxygen in the exhaust gas and output signals accordingly. The ECM selectively adjusts the air and/or fuel of the air/fuel mixture based on the output of the oxygen sensors. For example, the ECM may adjust the air/fuel mixture to produce a stoichiometric air/fuel mixture (e.g., 14.7:1). Therefore, it is beneficial for the oxygen sensors to accurately read the air/fuel mixture of the exhaust gases. Accurate readings allow the ECM to adjust the air fuel mixture in the cylinders correctly so that the engine operates at peak performance.

Adjustments of the air/fuel mixture by the ECM also vary the components of the resulting exhaust gas. For example, combustion of a lean air/fuel mixture (e.g., greater than 14.7:1) produces exhaust gas that is hotter than exhaust gas produced when a stoichiometric air/fuel mixture is combusted. The exhaust gas resulting from combustion of the lean air/fuel mixture may also include a greater concentration of nitrogen oxides (NOx) than exhaust gas produced by combustion of the stoichiometric mixture. A rich air/fuel mixture (e.g., less than 14.7:1) may produce cooler exhaust gas having a greater concentration of carbon oxides than the exhaust gas produced by combustion of the stoichiometric mixture.

Accordingly, there is a need for an optimized exhaust manifold system which provides for optimized air fuel mixture to a vehicle engine.

SUMMARY

An exhaust manifold for a vehicle engine may include a plurality of pipes, a pod, a splined collector and a downpipe. Each pipe in the plurality of pipes are operatively configured to be coupled to a corresponding engine chamber at a proximate portion. The pod is operatively configured to align a flow of exhaust gas emerging from each of the corresponding engine chambers to the associated pipe in the plurality of pipes. The splined collector may receive the outlet ends of the pipes at a splined collector inlet. The downpipe may be affixed to the splined collector at a small diameter outlet portion. The downpipe may include a first oxygen sensor operatively configured to communicate with a second oxygen sensor disposed in a downstream catalytic converter and an ECM in order to regulate air and fuel for the vehicle engine.

An exhaust manifold for a vehicle engine may also be provided which includes a first pipe, a second pipe, a third pipe and a fourth pipe as well as a pod, a splined collector and a downpipe. The first pipe, the second pipe, the third pipe and the fourth pipe are each operatively configured to be coupled to a corresponding engine chamber at a proximate portion for each pipe. The pod may also be operatively configured to align a flow of exhaust gas emerging from each of the corresponding engine chambers to the associated pipe. The splined collector may receive the outlet ends of the pipes at a splined collector inlet. The downpipe may be affixed to the splined collector at a small diameter outlet portion. The downpipe may include a first oxygen sensor operatively configured to communicate with a second oxygen sensor disposed in a downstream catalytic converter and an ECM in order to regulate air and fuel for the vehicle engine.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 3:
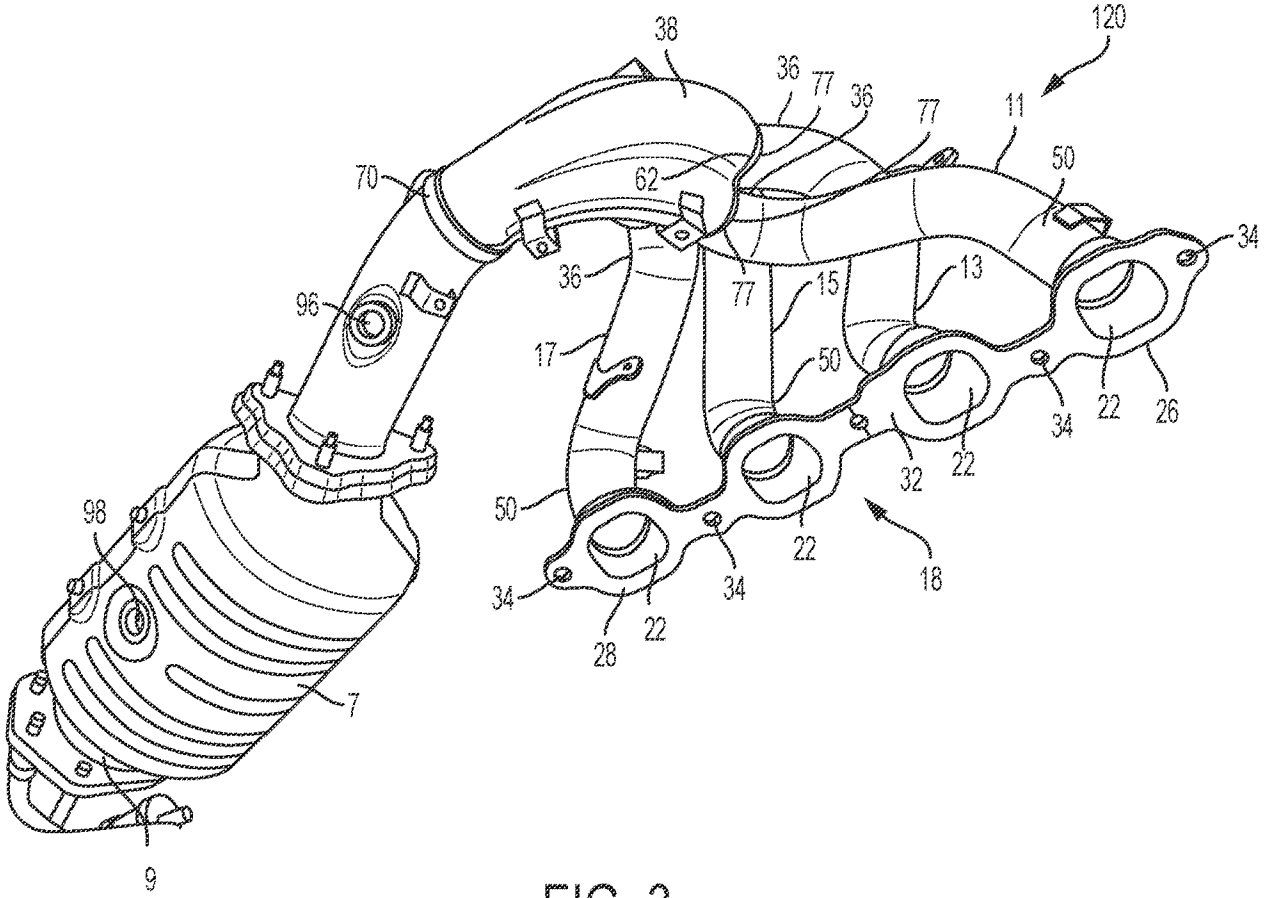
FIG. 3 is a bottom view of an exhaust manifold in accordance with multiple embodiments of the present disclosure.

A tubular exhaust manifold 1 in accordance with the present invention is shown in FIG. 3 may be bolted to the each side of a V-8 automotive type internal combustion engine 3 to collect exhaust gases emitted through four exhaust ports (not shown) on each side of the engine. The manifold 1 is connected to the upstream end of an exhaust pipe 5 and discharges exhaust gases into it so that they may flow downstream to a catalytic converter 7 which, in turn, discharges treated gases into a conduit 9 that carries them downstream to a sound attenuating muffler (not shown) and to discharge at the rear of an automobile or other vehicle empowered by the engine 3.

Figure 1:
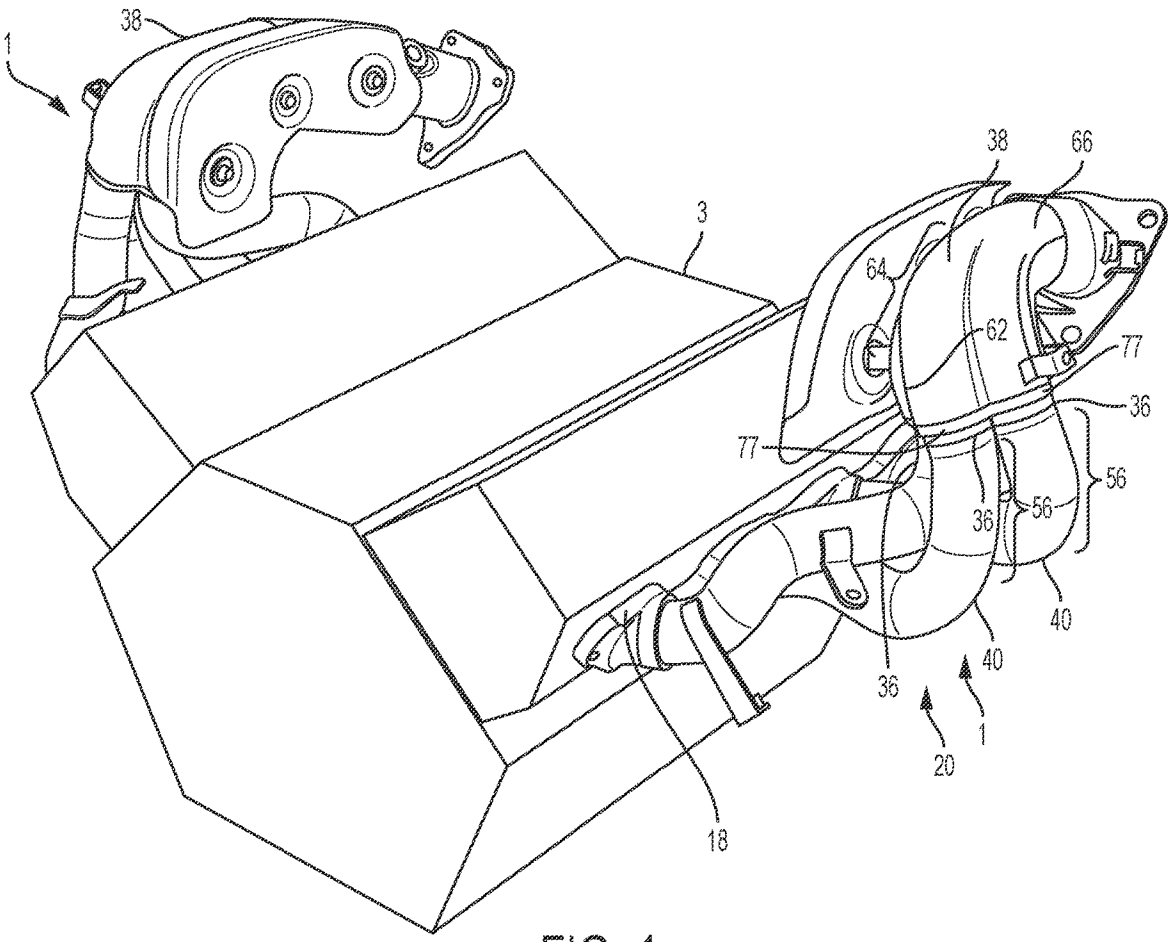
FIG. 1. is an isometric view of an engine having an exhaust manifold in accordance with multiple embodiments of the present disclosure disposed on each side of the engine.
Figure 2:
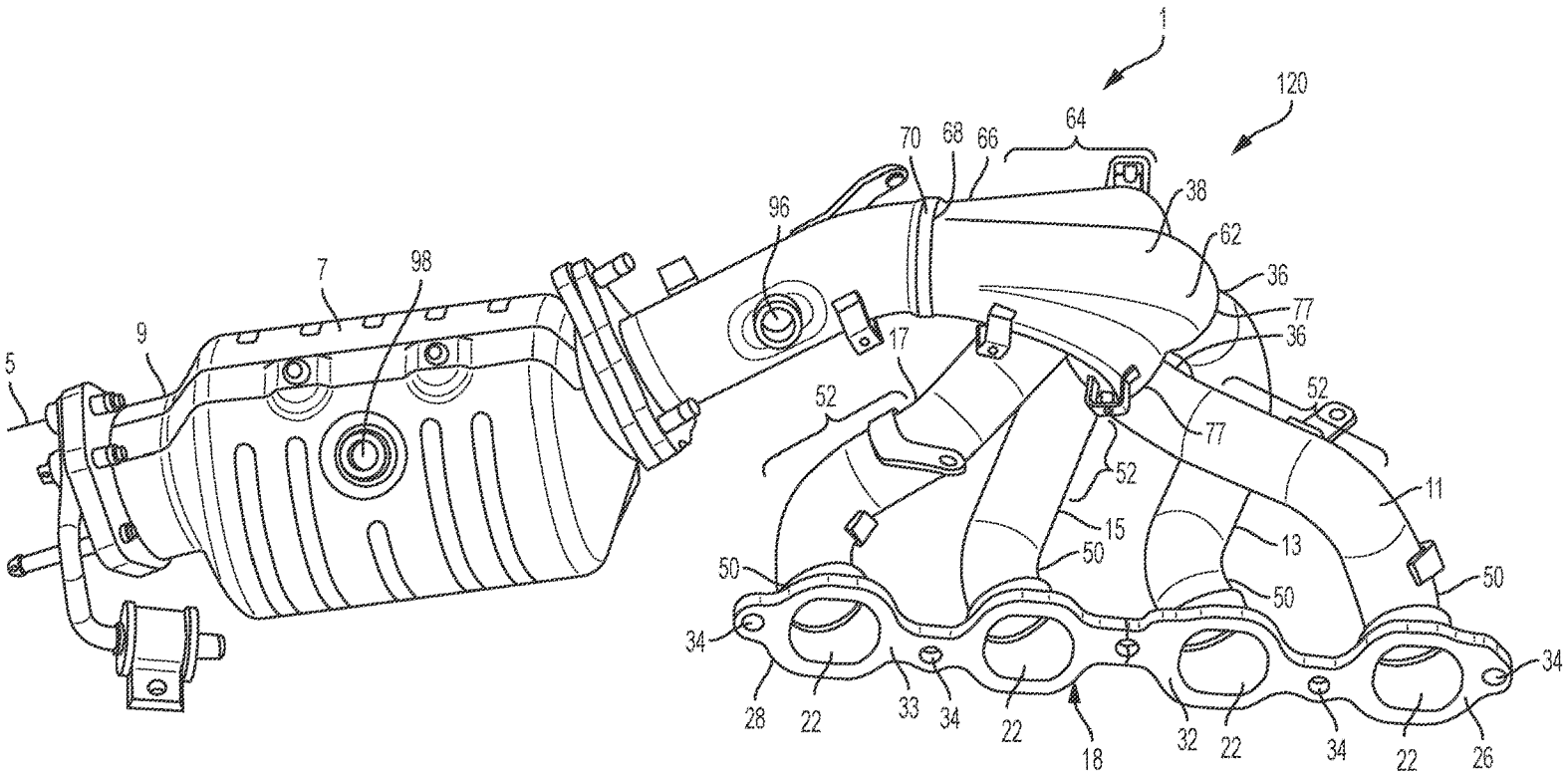
FIG. 2 is a first side view of an exhaust manifold in accordance with multiple embodiments of the present disclosure.

The manifold 1 is essentially symmetrical with respect to a longitudinal mid-plane and, as seen in FIGS. 1, 2, and 3, has relatively mid-length tubular headers or pipes 11, 13, 15, 17. The pipes 11, 13, 15, and 17 are preferably commercially available tubing of circular cross section, which have slight bends in the tubing to facilitate the high velocities of the exhaust gases within the tube while maintaining the best possible flow. The tubes or pipes 11, 13, 15, 17 are shaped to the configurations shown, or to other suitable configurations which allow the tubular pipes 11, 13, 15, 17 to maintain the same length. Low carbon steel, preferably, stainless and heat resisting, are desirable to facilitate manufacture and to give substantial durability under the punishing conditions imposed on an automobile exhaust system.

Figure 4:
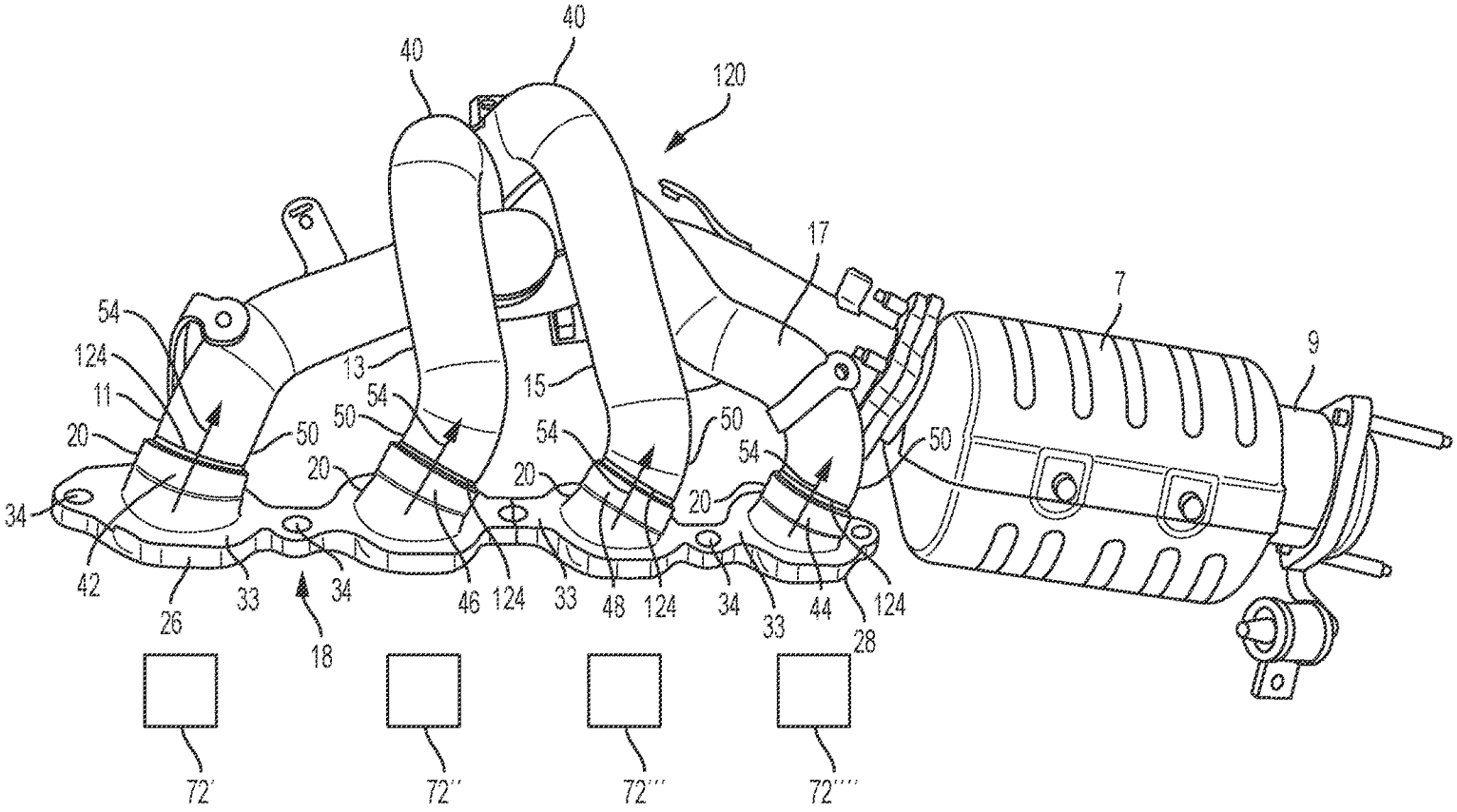
FIG. 4 is a second side view of an exhaust manifold in accordance with multiple embodiments of the present disclosure.

Each pipe in the plurality of pipes 120 (first pipe 11, second pipe 13, third pipe 15, and fourth pipe 17) are separate conduits for exhaust gas leaving four separate cylinders of the engine 3, and are connected to the engine over and in fluid tight communication with their exhaust ports by means of at least one pod 26, 28 on each side of the engine. Pod 18 of FIGS. 1-4 may be a one piece member which is shaped to receive the ends of the tubes. With reference to FIG. 4, pod flanges 20 define central openings 22 that are shaped to align the pipes 11, 13, 15, 17 to the exhaust flow as it exits the engine cylinders. In order to align the pipes 120 (first pipe 11, second pipe 13, third pipe 15, and fourth pipe 17) to the flow of exhaust that is exiting the engine, the pod flanges 20 and their associated central openings 22 are angled as shown to maintain alignment of the first pipe 11, second pipe 13, third pipe 15, and fourth pipe 17 relative to the exhaust gas flow exiting the corresponding engine chambers 72', 72", 72'", 72"". The angled pod flanges 42, 44, 46, 48 encourage the high velocity and flow 54 of the exhaust gases leaving each cylinder by staying aligned with flow of the exhaust gas. Accordingly, the exhaust gas flow 54 does not experience significant turbulence soon after it exits each cylinder.

Welds 124 (shown schematically in FIG. 4) between the end of each pipe 11, 13, 15, 17 and the pod flanges 20 make the connections fluid tight. Pod reinforcement 33 is formed around each pod flange 20 and may define a plurality of apertures 34 operatively configured to receive fasteners (not shown) for mounting the pod 26, 28 to the engine 3. Threaded fasteners may extend through the apertures 34 defined in each pod 26, 28 into the engine block 30. Pod reinforcement 33 is adapted to be coupled to the engine block 30 optionally via a plurality of fasteners (not shown). The pod reinforcement 33 may provide bearing surfaces for bolt heads or nuts whereby appropriate clamp load may be achieved to provide tight, lasting connection of the pod 18 to the engine 3.

As seen in FIG. 1, the pod inner surface 32 may be substantially in a common plane corresponding to that of the engine face against which the pod is bolted. The inherent elasticity of the plurality of pipes 120 as well as lateral bend 40 in second and third pipes enables the plurality of pipes 120 to function like a spring thereby allowing for elastic movement of the pipes when the vehicle is in motion and when the pipes receive exhaust pulses.

The plurality of pipes 120 shown in the example FIGS. 1-4 as first pipe 11, second pipe 13, third pipe 15, and fourth pipe 17 each have an outlet end 36 which are affixed to the splined collector 38. These four outlet ends 36 terminate in substantially a common plane at the splined collector 38. The four outlet ends 36 are bunched together in actual or substantial contact with each other, as seen best in FIGS. 1 and 3, where outlet ends 36 may be disposed inside of the splined collector 38 with respect to the engine side of the manifold. It is understood that the inlet end cross sections of the four pipes may also be shaped from the round cross sections of the respective pipes and may, but not necessarily, then be formed into substantially square cross sections with generously rounded corners when the pipes 11, 13, 15, 17 meet the splined collector 38.

Referring now to FIGS. 1 and 4, the second and third pipes (middle pipes) take on a similar (mirrored) first formation while the first and fourth pipes 11, 17 take on a similar (mirrored) second formation. It is understood that by taking on the aforementioned arrangement, the first, second, third and fourth pipes 11, 13, 15, 17 are arranged so that the first, second, third and fourth pipes 11, 13, 15, 17 are substantially the same length. Maintaining substantially equal length pipes provides for an exhaust manifold system which delivers exhaust gases to the collector at the same time at an equal speed which thereby produces an equal mixture of the exhaust gases from each of the four cylinders once the exhaust gases reach the collector. This ideal mixture provides for an accurate fluid medium upon which the first and second oxygen sensors 96, 98 (shown in FIGS. 2 and 3) in the exhaust system 1 may collect data.

Referring again to FIGS. 1 and 4—when affixed to an engine 3, second and third pipes 13, 15 extend in a lateral direction away from the engine toward lateral bend 40. From lateral bend 40, the middle pipes—second and third pipes 13, 15 then extend in an upward vertical direction toward the splined collector 38. The lateral extension of second and third pipes 13, 15 toward lateral bend 40 (FIG. 1) allows for second and third pipes 13, 15 to be spaced apart from the engine at lateral bend 40 such that first and fourth pipes (outer pipes) 11, 17 may extend from the first and fourth cylinders 72', 72"" toward and below the splined collector 38. Accordingly, the outlet ends 36 of the first and fourth pipes (outer pipes) 11, 17 are proximate to the engine 3 relative to the second and third pipes (middle pipes) 13, 15 when the first, second, third and fourth pipes 11, 13, 15, 17 join at the splined collector 38. As shown, second and third pipes 13, 15 may be rather horn-shaped due to lateral bend 40. As shown, lateral bend 40 allows second and third pipes 13, 15 to also achieve a length which is substantially similar or equivalent to the lengths of the first and fourth pipes 11, 17—which connect to first and fourth cylinders 72', 72"" disposed further away from splined collector 38.

While one aspect of the present disclosure contemplates first, second, third and fourth pipes 11, 13, 15, 17 having substantially equal length, the first, second, third and fourth pipes 11, 13, 15, 17 of the present disclosure include a relatively small diameter and arrangement to encourage the flow of high velocity exhaust gas within the exhaust manifold assembly 1. Therefore, in order to maintain the high exhaust gas velocity and to maintain rapid flow of the exhaust gas, the first, second, third and fourth pipes 11, 13, 15, 17 implement only gradual bends and implement a relatively smaller inner diameter along the entire length of each of the first, second, third and fourth pipes 11, 13, 15, 17. By maintaining a relatively smaller inner pipe diameter, the exhaust gases (upon expulsion from each chamber) maintains a rapid velocity and a low pressure. Accordingly, the desired vacuum effect within each cylinder chamber of the engine is achieved in that the exhaust gases are substantially removed from each cylinder and rapidly move toward the collector due to the unique exhaust manifold configuration.

In order to further achieve the objective of maintaining high exhaust gas velocities and rapid exhaust gas flow within the exhaust manifold assembly, the present disclosure also implements an aligned entry area for each of the first, second, third and fourth pipes where the proximate portion 50 of each pipe 11, 13, 15, 17 is aligned with the flow 54 of the exhaust gas coming from each cylinder. As indicated earlier, proximate portion 50 of each pipe 11, 13, 15, 17 is welded into a corresponding pod flange 20. As shown, pod flanges 20 are angled and aligned with the exhaust flow coming out of the each cylinder so as to maintain the rapid exhaust gas velocity and rapid flow of the exhaust gases coming out of each cylinder 72', 72", 72''', 72''''.

The proximate portion 50 for each pipe 11, 13, 15, 17 gradually blends with a relatively long, intermediate portion 52 as shown in FIG. 4. An outlet portion 56 (shown in FIG. 3) for second and third pipes follows after lateral bend 40 to flow into splined collector 38. The upwardly slanted, straight proximate portions 50 (at the engine and pod flanges) are sufficiently spaced from one another to provide tool access and clearance the assembly or service of pipes.

Referring back to FIGS. 1 and 4, the outlet ends 36 for each pipe 11, 13, 15, 17 are received in and empty into the hollow interior of the splined collector 38. The splined collector 38 has a large diameter inlet portion 62, a splined intermediate portion 64, and a smaller diameter outlet portion 66 that may be welded at end 67 to a bushing 70. It is also understood that splined collector 38 is relatively longer (about 8 inches) from the inlet portion 62 to the outlet portion 66 compared to traditional collectors. The relatively longer dimension is operatively configured to allow for the combination of the exhaust gas flow 54 to maintain a high velocity at low pressure.

The bushing 70 (FIGS. 2 and 3) is the location whereby splined collector 38 may be welded to downpipe 13). Moreover, as shown, the large diameter inlet portion 62 of the collector 38 may be shaped into curved sections 77 (FIGS. 1-3) that fit close to the semi-circular outer portions of the pipe ends 11, 13, 15, 17, as seen best in FIGS. 1-3. The large diameter inlet portion 62 of splined collector 38 is united by a weld 77, extending all the way around the collector 38, to the respective tube ends 36. Weld 77 rigidly integrates the four pipes 11, 13, 15, 17 and the collector 38, and therefore, produces a strong, gas-tight manifold base containing the splined collector 38 to which exhaust gas from all four cylinders 72', 72", 72''', 72'''' is delivered and from which it flows to the catalytic conversion and sound attenuation system. Additionally, the natural elasticity of the first, second, third and fourth pipes 11, 13, 15, 17 furnishes sufficient resiliency to accommodate slight shifts in relative positions of different parts of the manifold such as might occur, for example, when it is bolted to the engine.

The fabricated metal exhaust manifold 1 of the present disclosure is a significant improvement over conventional cast iron manifolds ordinarily used with automotive internal combustion engines. In the conventional manifold, exhaust gas from each of the four exhaust ports would flow directly into a common chamber. Use of the separate pipes 11, 13, 15, and 17 provides a means for the design engineer to improve engine performance and efficiency by tuning them to some extent to the individual cylinders. The smooth, gently curving walls of the pipes reduce turbulence and improve gas flow. The savings in weight over a cast iron manifold may easily be 50% to 65% or more per manifold. For example, the manifold 1 for a certain application weighs about 5 pounds while the corresponding cast iron manifold weighs about 12 pounds. The improved flow efficiency combined with the significant vehicle weight reduction enable the manifold 1 to make an important contribution to economy of engine operation and fuel conservation. Additionally, the manifold 1, being much lighter than a cast iron manifold, is much less of a heat sink and permits more engine heat to reach the catalytic converter 7, particularly on engine start-up, thereby improving the efficiency and effectiveness of the catalytic conversion system. Mechanical features of the manifold 1 have been previously mentioned. The design is neat and simple, sturdy and durable, occupies only a small space and therefore defines a small envelope, provides accessibility for easy installation, and accepts significant loads encountered in actual engine and vehicle operation, as well as at assembly, without material failures.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An exhaust manifold for a vehicle engine comprising:

a first pipe, a second pipe, a third pipe and a fourth pipe each having a proximate portion and each being operatively configured to be coupled to a corresponding engine chamber at the proximate portion;

a pod having a pod reinforcement integral to a plurality of angled pod flanges, each angled pod flange in the plurality of angled pod flanges being operatively configured to support and align a corresponding proximate portion of each of the first pipe, the second pipe, the third pipe and the fourth pipe to a corresponding exhaust gas flow, the proximate portion for each of the first pipe, second pipe, third pipe and fourth pipe being exterior to the vehicle engine;

a splined collector operatively configured to receive an outlet end of each of the first pipe, the second pipe, the third pipe, and the fourth pipe at a splined collector inlet, the splined collector being downstream of the proximate portion of each of the first pipe, second pipe, third pipe and fourth pipe; and a downpipe affixed to the splined collector at a small diameter outlet portion, the downpipe having a first oxygen sensor operatively configured to communicate with a second oxygen sensor;

wherein each angled pod flange is obliquely angled relative to the pod reinforcement.

2. The exhaust manifold of claim 1 wherein the pod is formed from at least two members.

3. The exhaust manifold of claim 1 wherein the plurality of angled pod flanges and the pod reinforcement are formed as one unitary member.

4. The exhaust manifold of claim 1, wherein the first pipe, the second pipe, the third pipe and the fourth pipe are substantially the same length.

5. The exhaust manifold of claim 4 wherein the second and third pipe each define a lateral bend so that a portion of the first and fourth pipes may be disposed between the engine and the second and third pipe proximate to the splined collector.

6. The exhaust manifold of claim 4 wherein the first pipe, the second pipe, the third pipe and the fourth pipe each implement a plurality of gradual bends.

7. The exhaust manifold of claim 6 wherein the first oxygen sensor is affixed to a wall of the downpipe.

8. An exhaust manifold for a vehicle engine comprising:

a plurality of pipes, each pipe in the plurality of pipes being operatively configured to be coupled to a corresponding engine chamber at a proximate portion;

a pod operatively configured to align and support the proximate portion of each pipe in the plurality of pipes, which are exterior to the vehicle engine, with a flow of exhaust gas emerging from each of the corresponding engine via a plurality of angled pod flanges, the plurality of angled pod flanges being disposed exterior to the vehicle engine and being integral to and being disposed obliquely to a pod reinforcement;

a splined collector operatively configured to receive an outlet end of each of the plurality of pipes at a splined collector inlet; and a downpipe affixed to the splined collector at a small diameter outlet portion, the downpipe having a first oxygen sensor operatively configured to communicate with a second oxygen sensor;

wherein the proximate portion of each pipe in the plurality of pipes is exterior to the vehicle engine.

9. The exhaust manifold of claim 8, wherein each pipe in the plurality of pipes is substantially the same length.

10. The exhaust manifold of claim 9 wherein at least two middle pipes in the plurality of pipes each define a lateral bend so that a portion of at least two outer pipes may be disposed between the engine and a portion of the at least two middle pipes proximate to the splined collector.

11. The exhaust manifold of claim 9 wherein each pipe in the plurality of pipes implement a plurality of gradual bends.

12. The exhaust manifold of claim 11 wherein the first oxygen sensor is affixed to a wall of the downpipe.

13. The exhaust manifold of claim 9 wherein each pod flange in the plurality of angled pod flanges correspond to a pipe in the plurality of pipes such that the proximate portion of each of the plurality of pipes is disposed within the corresponding pod flange.

14. The exhaust manifold of claim 13 wherein each corresponding pod flange is angled such that an internal passage of each corresponding pod flange is directionally aligned with a corresponding exhaust gas flow exiting from a corresponding engine chamber and each corresponding pod flange is operatively configured to receive a corresponding proximate portion for each of the plurality of pipes.

15. The exhaust manifold of claim 13 wherein the pod is formed from at least two members.

16. The exhaust manifold of claim 13 wherein the plurality of angled pod flanges and the pod reinforcement are formed as one unitary member.

* * * * *